United States Patent [19]

Weber

[11] Patent Number: 4,924,109

[45] Date of Patent: May 8, 1990

[54] DIM-DOWN ELECTRIC LIGHT TIME SWITCH METHOD AND APPARATUS

[76] Inventor: Harold J. Weber, P.O. Box 191, 20 Whitney Dr., Sherborn, Mass. 01770

[21] Appl. No.: 115,855

[22] Filed: Nov. 2, 1987

[51] Int. Cl.[5] ..... H01H 7/00; H05B 37/02

[52] U.S. Cl. ..... 307/126; 307/141; 315/360

[58] Field of Search ..... 307/126, 141, 141.4, 307/592–594, 597; 315/360, DIG. 4; 340/309.15; 323/311, 237, DIG. 905; 363/126

[56] References Cited

U.S. PATENT DOCUMENTS

| | | | |
|---|---|---|---|
| 2,896,125 | 7/1959 | Morton | 323/905 X |
| 3,461,375 | 8/1969 | Nestler et al. | 363/126 X |
| 3,940,660 | 2/1976 | Edwards | 307/141 X |
| 3,979,601 | 9/1976 | Franklin | 307/141 |
| 4,038,561 | 7/1977 | Lorenz | 307/141 |
| 4,151,515 | 4/1979 | Pease et al. | 340/309.1 |
| 4,287,468 | 9/1981 | Sherman | 315/DIG. 4 X |
| 4,292,570 | 9/1981 | Engel | 307/141 X |
| 4,300,090 | 11/1981 | Weber | 323/311 |
| 4,336,464 | 6/1982 | Weber | 307/141.4 |
| 4,379,237 | 4/1983 | Mosteller, Jr. | 307/141 |
| 4,389,599 | 6/1983 | Jabor | 307/141 X |
| 4,591,781 | 5/1986 | Larson | 307/141 X |
| 4,682,080 | 7/1987 | Ogawa et al. | 315/225 |

*Primary Examiner*—Vit W. Miska
*Assistant Examiner*—Sharon D. Logan

[57] ABSTRACT

An electrical timer which controls the ON-time of a light bulb circuit hooked up to a power source by way of an ordinary power switch. Usual operation of the timer is such that, when the power switch (which is initially OFF) is turned ON by a person, the light bulb which is connected to the switch by way of the timer will first turn-on FULL brightness for a period of time, after which it will DIM-down to about 30 to 50 percent brightness. In a fundamental version of the timer, the light bulb will remain in the dimmed-down mode until a person turns the light switch OFF. Another version allows that after a period of time in the dimmed-down mode, the light bulb will be fully shut OFF by the timer. The dimmed-down mode may also be arranged to occur in two or more level steps, i.e. part-DIM and full-DIM for example, with each step having a finite and substantial duration. A touch-strip may also be provided in which, when "touched" by a person, body capacitance serves to reset a dimmed-down light to full-brightness. The solid state modular timer may work in conjunction with any ordinary "two-terminal" wall-type electrical switch, such as commonly used in building construction.

20 Claims, 5 Drawing Sheets

DIM-DOWN ELECTRIC LIGHT TIME SWITCH METHOD AND APPARATUS

BACKGROUND OF INVENTION

Lights for hallways, storerooms, basements, and other seldom-occupied or pass-through areas are often left ON with the result that not only is a vast amount of electricity wasted, but also the useful lifetimes of the light bulbs which light the area are consumed unecessarily. Aside from the obvious cost of wasted electricity and the price of light bulbs, the very real labor cost for light bulb replacement is higher than might be realized, in the event that someone has to be hired to replace the burned-out bulbs, such as would be the usual case in apartment complexes, hospitals, offices, and similar commerical or business applications.

Dimmers, or higher-voltage (e.g., so-called "long life" or "130 volt") light bulbs, are sometimes used to cut the amount of light in these seldom frequented areas, but the result is usually a less than desirable level of lighting in both the aesthetic and security aspect. For example, when turning ON the light in a store-room or hall-way, it is desirable to have a good bright light in order to discourage any would-be attackers and, in general, to help the person gain quick visual orientation. Therefore, if the lights are merely permanently dimmed, the dull lighting conditions can lead to problems of safety, or at least a nerve wracking fear of there being a lack of safety, for any person using the area.

Aside from general building lighting, whether for security or appearance, there are other utilitarian applications for time-out switches which may better be served by a timer which does not abruptly switch from a bright level of illumination to full darkness. For example, the room occupied by an infant (or an infirm or elderly person) may best be served by having a switch which is capable of automatically dimming the light level after a finite period of brightness. This kind of lighting can enable a gentle sleep-inducing mood: and of course the DIM period may then be followed by darkness, if desired. Domestic garages are another area where the bi-level illumination is of good advantage. The light may be brought ON bright when the person enters the garage, whilst it assumes a DIM level soon thereafter: after the owner has driven away, for example. Also the device as I teach it can be hooked together with an automatic garage door opener to turn the lights full ON whenever the opener is actuated, while again dimming down some time later again. Maintaining the DIM level also serves to ward off prowlers without maintaining the stark, bulb-consuming bright illumination level otherwise had if the lights are merely left ON.

The desirability for automatically turning-OFF the lights after a period of time certainly has been addressed before by timing devices manufactured by several companies. For example, Paragon Electric Mfg. Co. of Twin Rivers, Wis. makes a model ET-600 "Switch Command" which allows a person to turn a room light ON, whereupon after ten or more minutes it will automatically turn the lights OFF . . . BANG, right into darkness! Intermatic Incorporated of Spring Grove, Ill. also produces a model EI-15-MH which does about the same thing. Also, this later company produces a model EJ-341 (which appears to have been derived from a model WT-341 timer made by Dynascan Corporation of Chicago, Ill.) that, while being adjustable in-so-far as timing periods are concerned, still plunges a controlled area immediately into full darkness when it reaches the OFF state. Thus it can be seen that a previous awareness of the problems of leaving lights ON unattended has been recognized to be of such significance as to justify substantial investment in the manufacture of products intended to overcome the underlying human nature problem of forgotten or otherwise left-on lights. The resulting performance of these earlier time switches is, however, rather severe in that having an area abruptly pitched into total darkness by a timed-out switch can lead to, at best, much frustration for any persons remaining in the area: both in the sense of mere inconvienence, and more importantly in regards to being put in a queazy situation involving their personal safety and wellbeing. As a result of the shortcomings found in these earlier devices, consumer resistance is encountered which serves to inhibit more universal application, and the resulting strong economic viability of this type of device as a product for any of the several manufacturers.

I observed the shortcomings of these earlier devices and then I realized that the mere dimming-down of the light level would serve to conserve electricity and save light bulb wear and tear, and at the same time prevent the undesirable pitching of the area into darkness. Instead of abruptly shutting off, area lighting would just be reduced to a DIM level from which a person can still safely exit. I also realized that, in order to be useful in older (pre-existing) installations, the circuitry associated with any timing device needs to work on one side of the line, like an ordinary wall switch. In effect, the device must be a two-lead configuration. While in my earlier U.S. Pat. No. 4,336,464 I do teach a "two terminal timed electric switch", I fall short of predicting the advantage now brought forth in obtaining a dimmed-down second state, in lieu of just simply shutting the lights OFF. This earlier patent does discuss the desirability for two-terminal operation, however. Furthermore, the mentioned Paragon and Intermatic timers operate as two-terminal devices on but one side of the line, in recognition of common domestic and commercial wiring practices (i.e., only two wires brought to a switch location).

I also have taught, in my U.S. Pat. No. 4,300,090 a "direct current power supply" that produces d.c. potential derived from current flow through one side of an a.c. power circuit. The essence of this power supply also served in my U.S. Pat. No. 4,336,464 as a source of d.c. potential for the timing circuits.

It is through the utilization of the essence of this d.c. power supply, combined with several new method and embodiment features, that I have now obtained a novel and efficient timer having capability for dimming down ordinary incandescent lights while working with but one side of a regular a.c. power circuit.

The timed switch I now teach also is shown to be operable in three states: (1) BRIGHT; (2) DIMMED Down; (3) OFF whereby a substantial period of full light BRIGHTness is followed by a goodly period of DIM lighting. After the elapse of the DIM lighting period, the light is shut OFF completely. This variation is of course particularly suited for those uses where even the power waste of an unattended DIM light is undesirable, such as in closets, storage areas, attics, and the like. It also provides a restful way to dim-down and darken an infant's or infirm persons room.

SUMMARY

You have probably left lights ON in unattended areas before and, upon your return (perhaps days later), found the light bulb burned out. That of course is just one of the most obvious detrimental symptoms of forgotten lights. In the sense of economic loss, much electricity is wasted by left-ON lights, why, a mere 60 watt bulb can consume about $4.30 worth of ten-cent per kilowatt hour electricity in a month. Also, the light bulb costs money (an ordinary 60 watt light bulb has a mere life expectancy of about 1,000 hours or, if left on continuously, about 41 days) and in many cases the labor cost for replacing the light bulb can far outpace the cost of the light bulb and the wasted electricity combined. In another sense, the waste induced by these factors is a real environmental loss in that the energy needed to produce the electricity and materials needed to make the light bulb must come from somewhere.

I know that others have realized these losses and have set forth devices which are intended to reduce such losses. However these earlier solutions introduced other shortcomings which, in a sense, were really more objectionable to the user than that of the mere waste of some resource such as electricity. Most specifically, when an area (such as a building foyer or hallway) is equipped with time-out switches such as those made by Paragon Electric Corporation or Intermatic Inc., they operate to pitch the area into darkness whenever the time cycle is up. What this means is that any person yet in the area will find themselves in an uncomfortable, if not literally unsafe, situation. Generally speaking, such a condition is not allowed to persist if objections are raised by persons frequenting the area: the result is a return to the old ways of providing a fully lighted area, and merely overlooking the (lower priority) problems of wasted energy and burned-out light bulbs.

Enter now my instant invention with its advantageous features of not only providing an energy saving timed dimming-down of the lights, but also of leaving a residual light level which is sufficiently bright to assure relatively safe conduct of any persons yet in the area. Furthermore, when it is desired to really turn the lights OFF after a period of neglect, that is accomplished by these teachings through first having the lights ON full brightness for a goodly period of time, followed by a dimming down to an intermediate level for another substantial period of time, whereupon the lights can then turn OFF. The intermediate dimmed-down period then can serve to "warn" the user that the lights are timing out, but yet enough time is afforded to allow safe exit from the area. In the practical application, having a dimmed-down period of about the same duration as that of the full-brightness period seems to be a good practical arrangement.

I have provided my device to be fully operative from the usual two leads found hooked to a standard single-pole wall switch. No third wire "common" is required, thus enabling ready installation in all sorts of pre-existing building wiring systems. My timer is capable of being used with any sort of already existing wall switch or the like, which makes the device more aesthetically compatible with its surroundings: use of existing decorative wall switches and cover plates are allowed. The timer may be manufactured as a compact module which can be installed in the wall box near the switch, or alternatively it can be installed adjacent with the light fixture. The casual user need not even know of the timers physical whereabouts while fully benefitting from its operative effects. Three-way and four-way switch operation is also obtainable, and the device, as reduced to a product, may be implemented in such form as to work with any common type of already existing wall switch. The invention is also compatible for use with lights hooked to remote garage door openers, or wireless (carrier current) controls now finding popularity in some homes. Additionally, the device may be used with conventional electromechanical timers, such as are frequently used for programming security lighting and the like. For example, my new dim-down timer may be hooked to the output of an ordinary electromechanical timer box type switch like an Intermatic model T-101 or Dayton model 2E021, whereupon when the timer turns the lights ON, they come on FULL bright, but then after a while they DIM down to a lesser brightness level until the electromechanical timer eventually shuts them off again.

I therefore provide as an objective for my invention, that the turning ON of a light switch hooked with an electric light will result in the attainment of a FULL-brightness light level followed, after a predetermined period of time, by a dimmed-down light level which may then persist until the principal switch controlling the light is turned OFF again.

It is yet another objective for the invention to show that the period of time during which the light level is dimmed down may actually consist of a more bright level followed by one or more less bright levels, e.g. the overall dimmed down period may be segmented in to periods of progressively decreasing brightness levels.

Still another objective for my invention is to provide apparatus which may hook-up with or replace an ordinary wall switch used for room lighting and the like, and thereby operate the room light in accord with the improvements introduced by my invention's performance.

Yet another remaining objective for my invention is to produce a timed light switch which operates with an electric light such as used in a room, hallway, or the like through the demonstratable advantage of having an initial FULL-brightness period of operation, followed by a subsequent period of lessened brightness from a light, instead of plunging the room into darkness after the initial FULL-brightness period as is known to be the result of present art timing devices.

A further objective for my invention is to provide resetability of the light from the dimmed-down state to a full-brightness state through the expedient of merely "touching" a body capacitance responsive touch plate, therefore enabling quick and sure restoration of light brightness without the necessity for turning the switch OFF even momentarily.

Of course an elemental objective of my invention is to conserve electricity and light bulb wear-and-tear through the expedient of reducing, albeit not full terminating, the light producing power committed to the light bulb after the lapse of a useful period of FULL power operation.

It is with these recited objectives, together with others which will undoubtedly become obvious to the astute artisan who shall explore and perhaps practice the essence of this invention, that the spirit of this invention resides.

DESCRIPTION OF DRAWINGS:

Five sheets of drawings showing six figures serves to illustrate the essence of my invention. The figures include.

DESCRIPTION OF MY INVENTION

Figure 1:
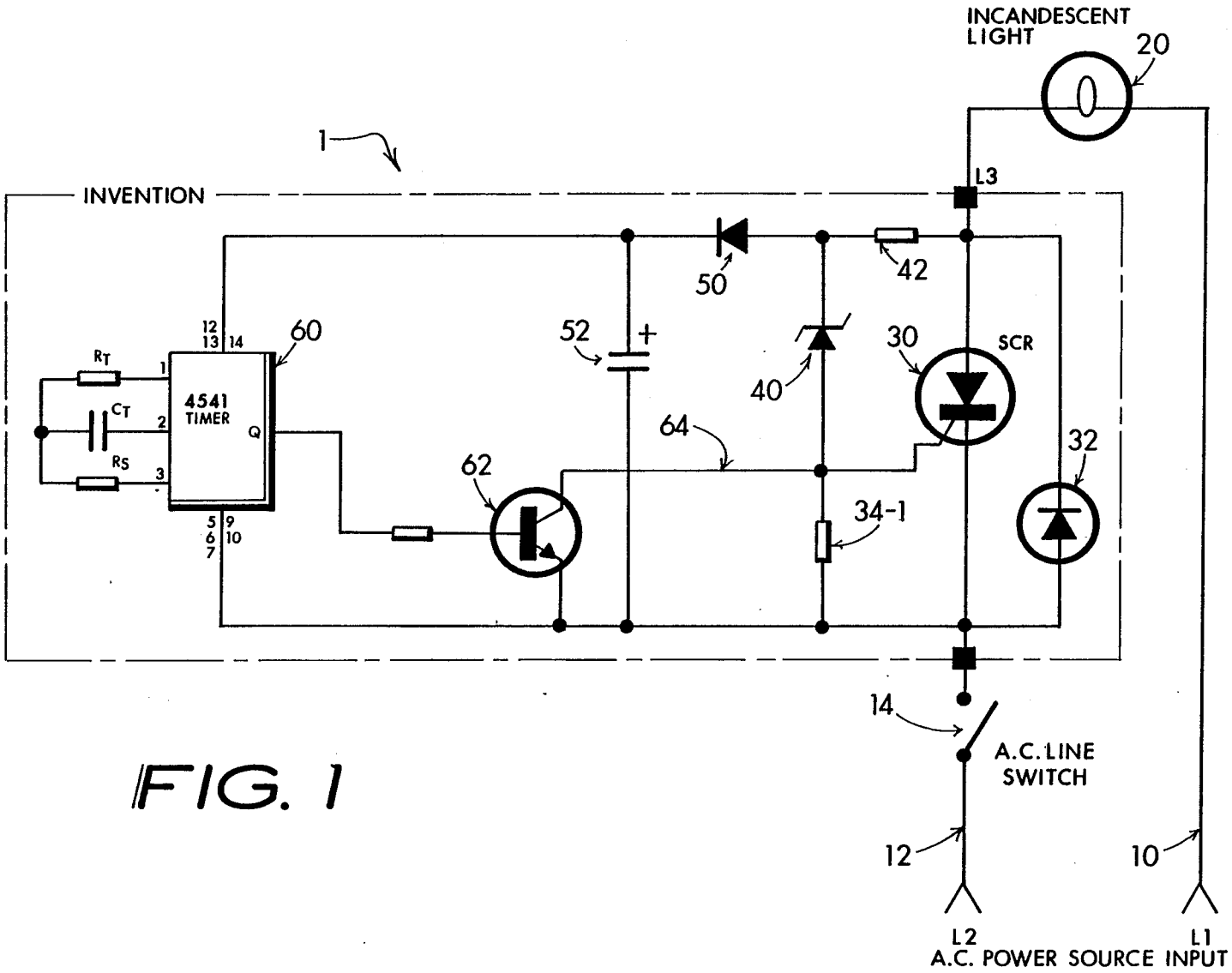
FIG. 1—Timer wherein the light comes on BRIGHT and then after a period of time is reduced to a DIM level.

In FIG. 1 you will find the timer portion of my invention enclosed within the broken lines, which serves to particularly portray the important essence of my invention which, amongst other points, includes the important capability for working with an ordinary line switch 14 (e.g., a common wall switch or the like) together with a regular incandescent light 20 which altogether couple 10, 12 with a source of a.c. (utility) power. As a practicable device, my invention may be a compact module which can simply be wired to a regular room light switch and, for that matter it can be physically installed at the light fixture. It does not have to be mounted near the wall switch. It likewise does not have to be physically part of the wall switch.

The timed switch 1 circuitry is set up to provide full lamp 20 brightness for an initial period of time preferably on the order of ten to thirty minutes after power is applied to the circuit, such as by closing the "light" switch 14, followed by a dim state which continues until the power is removed, such as might be provided by opening switch 14. A.C. power is coupled by lead 10 with one side of the light 20, and by lead 12 through switch 14 with the juncture of the cathode of a thyristor (silicon controlled rectifier) 30 and the anode of a power diode 32. Initially the thyristor is OFF, and the voltage appearing on the anode rises relative with the cathode. The voltage increase introduces current flow through resistor 42 and into the zener diode 40, which couples with the gate of the thyristor and also returns to the thyristor cathode through a relatively low value (e.g., usually 1,000 ohms or less) resistor 34-1. When the thyristor anode voltage rises sufficiently, the zener diode will abruptly conduct, introducing gate current into the thyristor which causes it to turn ON. This condition repeats every other power half-cycle, since the thyristor commutates whenever the a.c. power cycle reverses and the diode 32 couples a half cycle of power to the light 20. The effect is that nearly all of the a.c. power is now coupled with the light bulb, and full brightness will be attained.

The smallish voltage present across the thyristor anode to cathode junction prior to zener conduction is also coupled through rectifier diode 50 to charge a capacitor 52 to a level approximating the zener breakdown voltage level. This capacitor charge serves to power the integrated circuit 60 which may be a Motorola MC14541 timer as shown. The components attendant with the timer 60 serve to clock the timer, with the output as coupled with the base of the transistor 62 being initially LOW. The timer is essentially a 16 stage binary counter, and thus with the components chosen to provide a 36 hertz clock frequency will result in about 15 minute delay of the output before its Q output goes HIGH as coupled with the transistor 62 base. When the timed out period occurs, the HIGH level on the transistor base causes the collector to saturate, pulling it to near emitter level and of course pulling the thyristor gate to the same level which is below the point where sufficient gate current can enter the thyristor to turn it ON. Thus the thyristor, being starved for gate current, remains OFF, and the only power now coupled with the light is by way of the power diode 32 resulting in half-cycle power flow and about 30–50% brightness from the light. Under this condition, the resistor 42 acts as a ballast resistor together with the voltage clamping action of the zener diode 40 and therefore the voltage coupled with the storage capacitor 52 through diode 50 remains about the same.

You need to realize that, if the zener diode 40 were not coupled with the gate of the thyristor as I show, but rather merely to the cathode (e.g., common return) as is more common practice there would be no voltage available across the thyristor when it is ON to couple through the diode 50 with the storage capacitor 52 and the timer would cease to work properly when the light was on BRIGHT. The essence of this kind of novel power supply is more fully discussed in my earlier U.S. Pat. No. 4,300,090.

Figure 2:
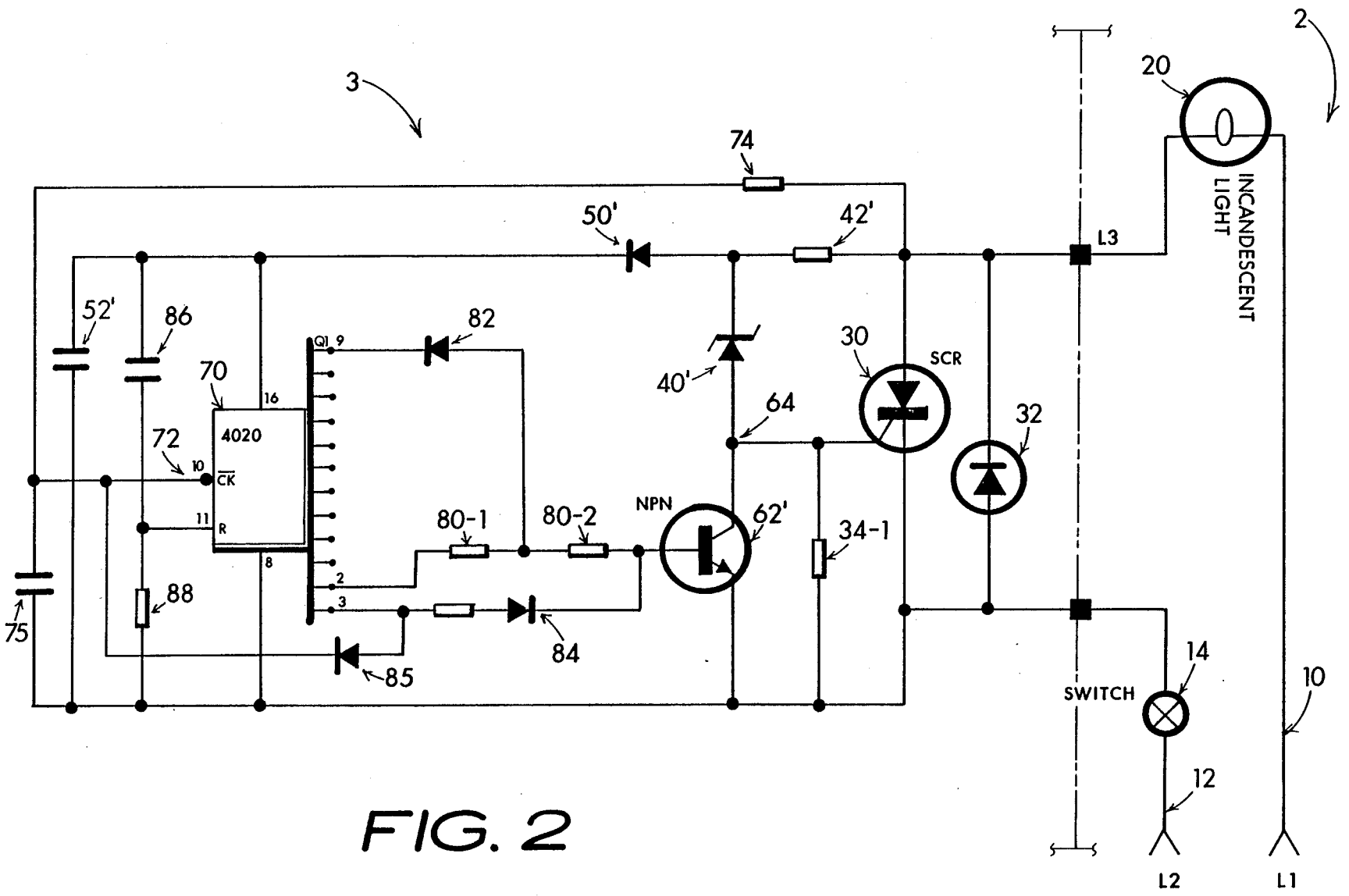
FIG. 2—Timer wherein the light comes on BRIGHT, then reduces to an intermediate DIM level, and finally to a lower DIM level.

The timed switch configuration 3 of FIG. 2 produces a couple of intermediate (dimmed down) levels of illumination from the light 20, which is hooked to a typical lighting circuit arrangement 2 including a switch 14'. A fourteen-stage C-MOS integrated circuit timer 70, shown as a Motorola type MC14020P obtains CLOCK signals at the input 72 thereof through resistor 74 from the a.c. pulses present across the thyristor 30. The resistor 74 (about 100 K ohms) together with the capacitor 75 (about 5 nF) also serve an important purpose of providing some phase delay of the clock signal. Without this delay, some flitter of the light is noticable in the first dim step. You will also find that auto-reset of the timer is provided during power-up through the charging action of capacitor 86 through resistor 88, as coupled to the RESET input of the timer. Immediately after power-up reset, the higher output states of the timer are all LOW (e.g., outputs Q13 and Q14 as shown), although the LSB output Q1 (pin 9) is clocking at one-half the a.c. line frequency. So long as the Q13 output on pin 2 is LOW, the base of the NPN transistor 62' receives no current and the transistor is OFF, allowing the zener diode 40' to turn the thyristor 30 ON, as was described relative with FIG. 1. After the elapse of about 4096 clocking cycles (or about 2.27 minutes for 60 hertz power) the Q13 output pin 2 will change HIGH, thereby coupling current through resistors 80-1 and 80-2 with the base of the transistor 62', thus clamping the thyristor gate to the cathode and effectively keeping it OFF. The time period may be found by:

$$T_D = \frac{2^{n-1}}{F_{CK} \times 60} = \text{delay in minutes}$$

where:

n=number of counter stages $F_{CK}$=counter frequency

You will also find, however, that the LSB output pin 9 of the counter is coupled through diode 82 with the juncture of resistors 80-1 and 80-2, and therefore whenever the Q1 output is LOW, current is diverted from the transistor 62' base. The thyristor is thus not allowed to be turned ON during the full period which otherwise would occur, but rather is retarded such that it turns ON late in the positive half of the a.c. power cycle, thus producing some effective dimming of the light 20. In my modelled embodiment, I obtained about a 20% reduction of light level, although this could be adjusted to various other values through juggling of the time constant value of resistor 74 and capacitor 75. After another 2.27 minutes elapses, the Q14 output pin 3 of the counter changes HIGH, thus coupling full current to the transistor 62' base, keeping it steady ON and thus fully inhibiting the thyristor with the result of producing a full dimming effect, say about 30–50% of normal brightness from a typical incandescent light bulb. In addition, the now HIGH output of the counter couples through diode 85 to clamp the CLOCK input of the counter 70 HIGH: thus inhibiting further counting action and maintaining the DIM state until reset of the counter is somehow obtained.

Figure 3:
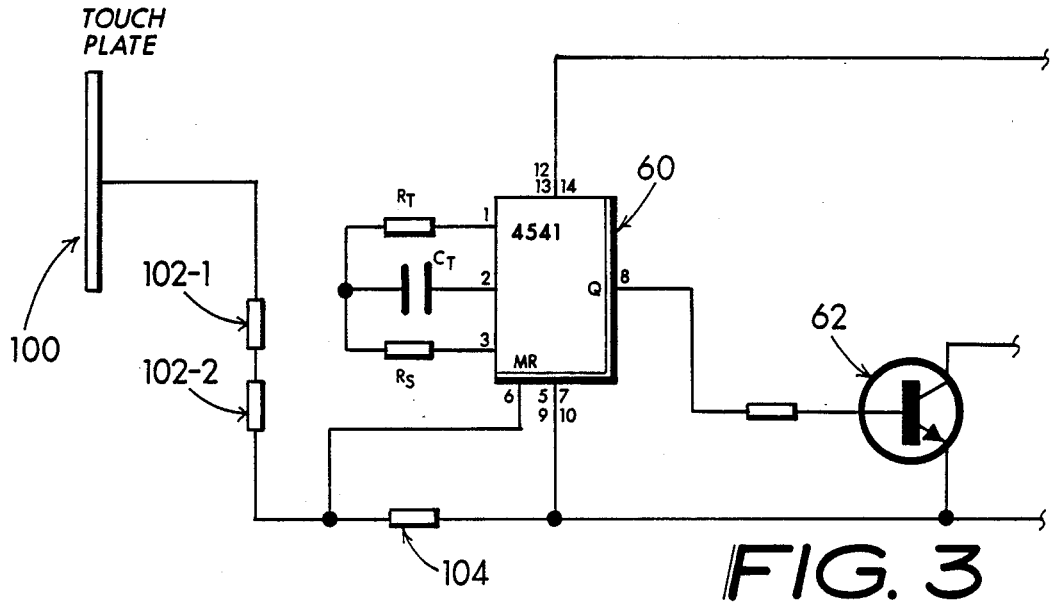
FIG. 3—Circuit adaptation for FIG. 1 showing inclusion of "Touch" control for resetting timer to BRIGHT level.

The partial circuit of FIG. 3 shows a functionally convienent arrangement for the timer of FIG. 1 wherein "touch" control (i.e., a person's finger merely touching the touch-plate) is used for resetting a dimmed down light back to the full brightness level. A conductive (metal) TOUCH PLATE 100 is provided to be exposed to the user, so that finger contact may be obtained. In practice, the contact plate may be a metal strip or the like on the bezel which surrounds the switch 14, both being mounted on the wall or other convienent location. When "finger contact" is made to the plate 100, a surge of residual static electricity together with hum-field and whatever electrical signals may be present couple with the master reset (MR) input pin 6 of the timer 60. Since in the shown timer the input pin is a C-MOS circuit configuration, the impedance is very high and the result is that it is very sensitive to any signal introduced from the plate 100 through the isolation resistors 102-1, 102-2 each being on the order of 1-megohm. The pull-down resistor 104, also about 1-megohm, serves to hold the MR input LOW and allow timer operation. Thus when one contacts the touch plate, an effectively positive signal is introduced which resets the timer. It should be noted that, in practice, the "noisy" signal introduced by finger contact with the touch plate is actually rectified (shunt detected) by the protective diodes intrinsic with the C-MOS input of the integrated circuit timer.

Figure 4:
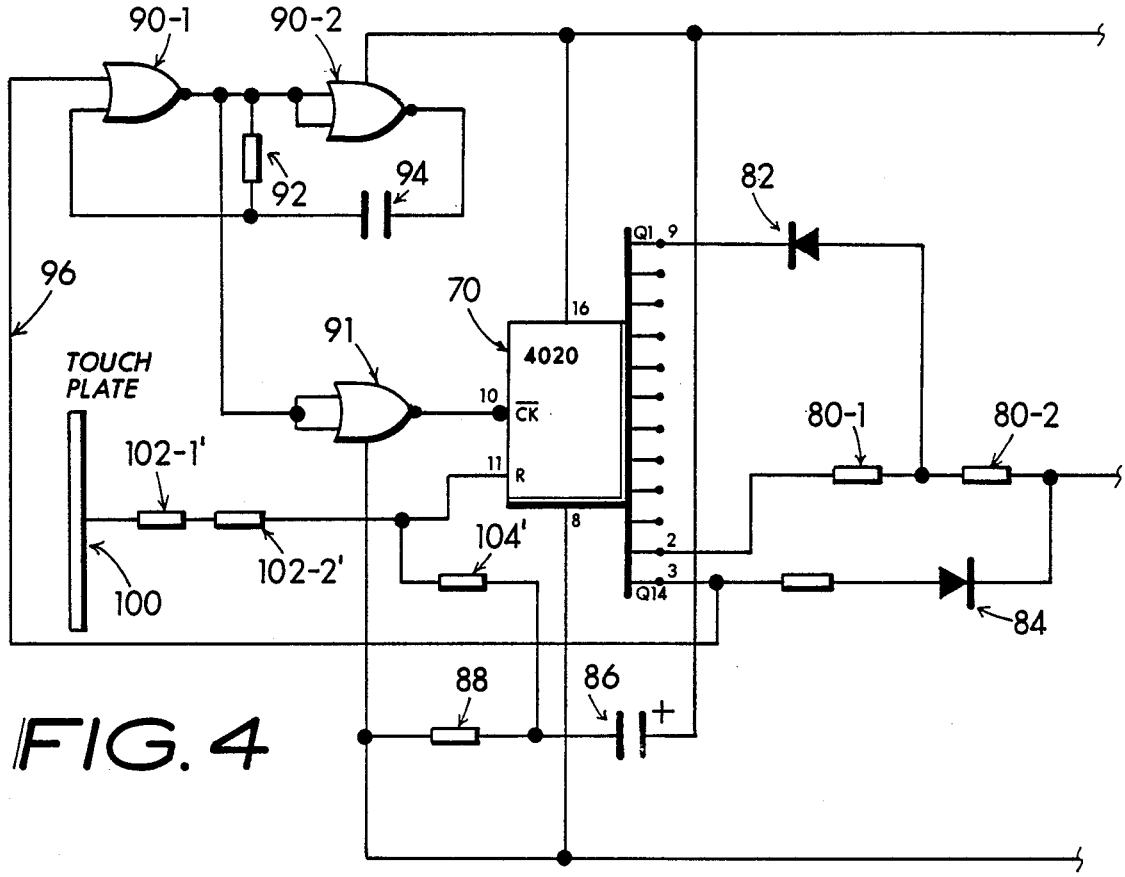
FIG. 4—Circuit adaptation for FIG. 2 showing inclusion of "Touch" control for resetting timer to BRIGHT level, together with clock oscillator to provide extended time operation.

In a like way, FIG. 4 shows "touch plate" resetting of the binary counter arrangement depicted in FIG. 2. The touch plate 100' couples via isolation resistors 102-1', 102-2' with the reset input pin 11 of the C-MOS counter 70. The pull-down resistor 104' is also coupled with the juncture of the power-on reset components 86, 88 and thus when power is first turn-on, the juncture level will be relatively HIGH until capacitor 86 charges down via resistor 88. The HIGH level momentarily couples through the resistor 104' to quickly reset the counter. It shall be realized that, through the use of very high resistance values (on the order of 1-megohm or more) for the resistors 102-1', 102-2' negligible current flow may occur and user safety is maintained.

I also extend the teaching of FIG. 2 to include a separate clock oscillator in FIG. 4, thus enabling longer time periods than what can be obtained from merely using the power line frequency. The oscillator includes NOR gates 90-1, 90-2 together with the timing resistor 92 and capacitor 94. The clock output couples through an inverter connected gate with the CLOCK input pin 10 of the counter. You will also note that I have connected the Q14 output from the counter to one of the NOR gate 90-1 inputs, thus serving to jam the oscillator whenever the counter has attained top-count for the MSB, thereby latching the timer in the DIM mode until reset.

Figure 5:
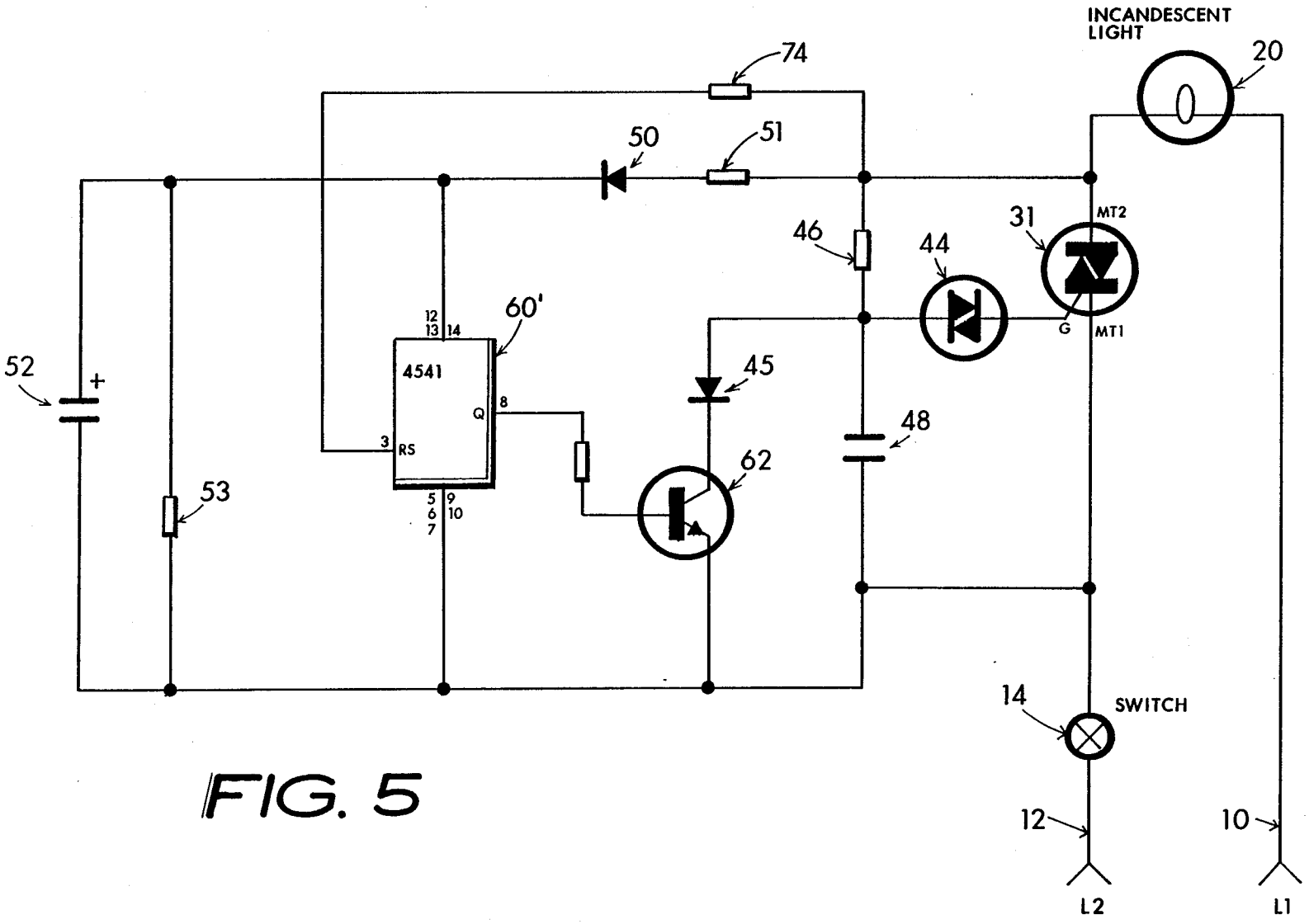
FIG. 5—Timer utilizing triac wherein the light comes on BRIGHT and then after a period of time reduces to a DIM level.

In FIG. 5 I show the use of a TRIAC bilateral thyristor 31 and gate firing circuit utilizing a DIAC 44, such as a General Electric type ST-2 or R.C.A. type 45411 which, together with the resistor 46 and capacitor 48 will produce substantial current pulses capable of firing the gate of even cheap (e.g., less sensitive) TRIAC devices. A DIAC exhibits a modest break-over voltage which is, in essence, directly equivalent to the hold-off voltage provided by the zener diode 40 of FIG. 1. The result is that a small portion of the a.c. power voltage cycle appears across the TRIAC prior to conduction, which is then coupled through resistor 51 and rectifier diode 50, thereby being utilized on the positive half-cycle to charge capacitor 52 and thus provide d.c. voltage for circuit operation. You should understand that in this kind of power supply adaptation of my earlier U.S. Pat. No. 4,300,090 I merely call for the use of an abrupt breakdown diode and more generally, for a voltage responsive device. Obviously, the DIAC 44 satisfies this description. The timer 60' receives a clocking signal on pin 3, which is a sample of the 60 hertz a.c. line power frequency coupled through resistor 74'. Upon completion of the timing cycle, the Q output of the timer 60' goes HIGH and, being coupled with the base of the NPN transistor 62, causes the transistor to effectively saturate. When this occurs, the diode (such as a 1N914) clamps the juncture of the DIAC 44, the resistor 46, and the capacitor 48 to ground relative with positive half-cycle charging of capacitor 48 through resistor 46. Negative half-cycle performance is retained, however, since the diode 45 blocks negative swings. The result is that the TRIAC 31 will conduct alternate (negative) half-cycles and the lamp will be dimmed to about 30–50% brightness.

Figure 6:
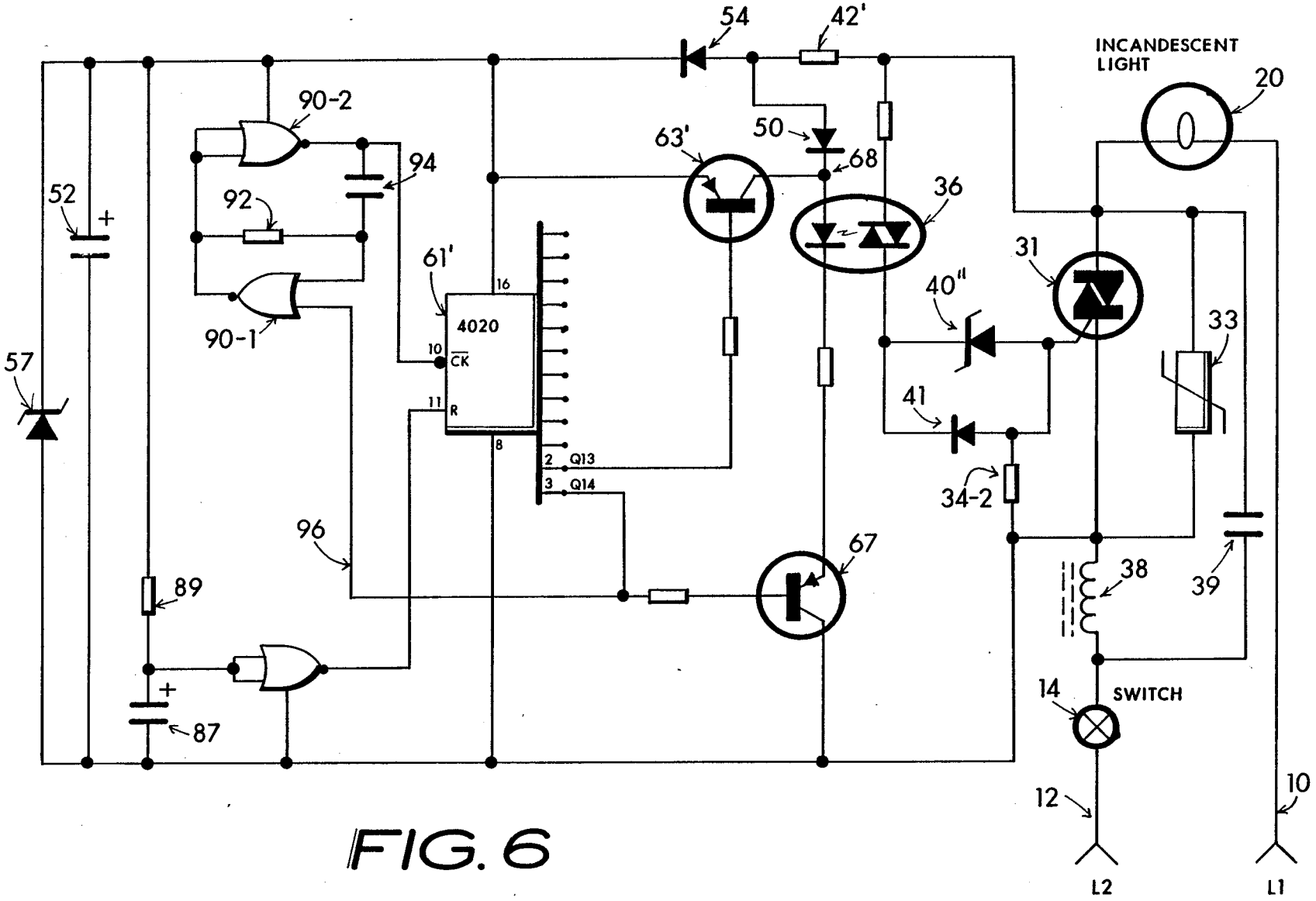
FIG. 6—Timer wherein the light comes on BRIGHT, then reduces to a DIM level, and finally shuts OFF.

In FIG. 6 you will find a counter 61' hooked up similar to what I taught in FIG. 4, in-so-far as clocking is concerned. The circuit of FIG. 6 operates in essentially three distinct modes:

1. FULL Brightness
2. Reduced (DIM) Brightness
3. OFF.

The gate of the thyristor 31 is coupled through the zener diode 40 with the triac driver optoisolator (optocoupler) 36, such as a Motorola MCP-3022 or General Electric Ge-3011. The light emitting diode portion of the optoisolator couples 68 with the juncture of the PNP transistor 63' and the diode 50. During the first timing period (BRIGHT period) the Q13 and Q14 outputs from the counter are both LOW. The result is that the base of the transistor 63' is biased ON and the transistor thus couples D.C. power to the optoisolator. In a like way, the LOW level on the Q14 output couples with transistor 67 biasing it ON. Thus the optoisolator is steady ON, resulting in full-cycle conduction through the triac 31 excepting of course for the slight positive cycle delay introduced by the action of the zener diode 40. After the BRIGHT time period elapses, counter output Q13 will go HIGH, resulting in the transistor 63' shutting OFF. However, positive half-cycle conduction will continue through the diode 50, and the result is that the triac will be turned ON for alternate half-cycles for about 50% power coupling to the light 20, resulting in about 30–50% of full brightness from the light. When the DIM period elapses, Q13 will again go LOW, but no matter because now Q14 will also go HIGH and the PNP transistor 67 will be cutoff thus inhibiting the optocoupler and shutting off the triac. At the same instant, the Q14 HIGH level couples via line 96 with the input of NOR gate 90-1 thus inhibiting the multivibrator and latching the timer in the OFF state until reset occurs. When the triac is OFF, the rectified d.c. voltage may rise above desirable levels and therefore I have include an ancillary zener diode 57 as a clamp. The zener voltage may be several volts higher than that of the usual d.c. voltage developed in the circuit when in the BRIGHT or DIM mode. In practice, through sizing of the zener diode 40 together with the dropping resistance 42' and capacitor 52 I have obtained about 8 volts d.c. which has been found to operate the circuit reliably, and therefore the protective clamp zener 57 may be a 10-volt device such as an inexpensive type 1N4740.

In the circuit of FIG. 6 I have also shown the inclusion of radio frequency interference filtering in the form of an r.f. choke 38 connected in series with the thyristor, and a capacitor 39 shunting the thyristor. As is well known, the quick switching characteristic of a thyristor tends to generate interference rich in harmonics and thus some filtering such as these components provide would also be of advantage in the circuits shown in the other figures. I also show the TRIAC 31 shunted with a metal oxide varistor 33, such as a General Electric V150LA2, which serves to protect the thyristor from damaging a.c. line spikes.

You should appreciate that my invention merely couples in series with a typical, already-in-place wiring circuit typical of usual building trades practice. As such, it does not require a special switch, nor connection to "both" sides of the a.c. power line for operation. All power is derived from power flow through the switch. Safety is assured through utilization of a regular "toggle" switch in series with the timer which may be shut off in order to fully kill the circuit. Approval by safety authorities, such as the Underwriter's Laboratories may therefore be more easy to obtain. This ability to use the ordinary kind of switch also allows use of my device without detracting from a building's architectural continuity of appearance. The known prior-art timer products, aside from affording inferior operation, all tend to be obtrusive and homely, which may reduce consumer acceptance.

You will realize that I have shown some particular arrangements for obtaining the results taught by my invention. However these arrangements are merely illustrative, and for the convienence of ready understanding by a properly skilled artisan. In no way are the particular details of these arrangements defining any sort of embodiment limitation, in that it is well understood in the art that many other combinations of components can be had which will just as well produce the same desired result. For example, other types of counters might be used, and the control of thyristor gate firing might be obtained by other means such as pulse transformers, etc. Again, attaining the essential BRIGHT operating period, followed by a DIM period is of course obtainable by other circuitry hookups. It is the actual performance of giving a BRIGHT time period followed by a DIM time period subsequent to the application of power to the circuit which remains as the underlying essence of my invention, particularly when such operation can be obtained in conjuction with any ordinary light switch. Furthermore, a practitioner might also produce a design which has more than the detailedly described two steps: again this is merely an obvious variation, and I have anticipated having numerous intermediate (DIM) steps . . . even so many that they seem to blend together in to producing the illusion of smoothly gliding from the most bright DIM level to the least bright DIM level subsequent to the timing-out of the BRIGHT time period. Furthermore, it is clear that the time duration of the BRIGHT period and the DIM period may be greatly different: for example, the BRIGHT period may be very brief, and the following DIM period very long, followed perhaps by being completely turned OFF. Alternatively, the BRIGHT period may be long, followed by a brief DIM period and a subsequent OFF state. Any mix of these state periods is merely an implementation detail. I have quite practically utilized the power supply of my earlier U.S. Pat. No. 4,300,090 because it is a convienent way to develop a low d.c. voltage for circuit operation. However it should not be construed as a constraint, and any scheme suitable for developing the necessary low d.c. voltages is an acceptable way to practice the invention without deviation from the underlying invention's teachings as brought forth in the appended claims. Lastly, while I show implementations utilizing primarily digital techniques, by no way is this to be construed as a limitation but merely as an expedient giving good illustration for obtaining the desired results. For example, an analog timer such as the Intersil type 555 may be utilized interchangeably (in a functional sense) with any of the shown digital timers and essentially equivalent overall results will be obtained. Such variations all fall within the scope of the capabilities of anyone having ordinary skill in the art.

What I claim is:

1. Timed lighting method comprising the steps of:

a. providing a series electrical circuit including a source of alternating current electric power, a load device usually in the form of an incandescent light bulb, and a switch means effective for connecting and disconnecting electrical coupling of the light bulb with the power source;

b. coupling an electrical timing device substantially in series with the load device, the switch means, and the power source, whereby subsequent to initiation of current flow through the circuit the timing device operation serves to:

ba. couple full-cycles of alternating current electrical power to produce about symmetrical power flow between the power source and the load device for a first period of time; and, bb. couple a portion of every-other half-cycle of alternating current electrical power to produce asymmetrical power flow between the power source and the load device for a successive second period of time.

2. Timed lighting method of claim 1 wherein the timing device operation further serves to disconnect any substantial power flow between the power source and the load device subsequent to the elapse of at least the first period and second period of time.

3. Timed lighting method of claim 1 wherein the step of coupling a portion of every-other half cycle of alternating current electric power for a second period of time comprising the further steps of:

a. producing said second period as a successive plurality of portions of time;

b. coupling a greater portion of every-other half-cycle of asymmetrical a.c. electrical power between the power source and the load device for a first said portion of time; and, c. coupling an incrementally diminished lesser portion of every-other half-cycle of asymmetrical a.c. electrical power between the power source and the load device for successive portions of time.

4. Timed lighting method of claim 1 comprising:

a. coupling substantially bidirectional a.c. current flow between the source and the load during the first period of time; and, b. coupling substantially unidirectional a.c. current flow between the source and the load during the second period of time.

5. Timed lighting method of claim 1 comprising:

a. coupling nearly a full 360 electrical degrees of substantially symmetrical current flow between the source and the load for each a.c. power cycle during the first period of time; and, b. coupling not more than about 180 electrical degrees of substantially asymmetrical current flow between the source and the load for each a.c. power cycle during the second period of time.

6. Timed lighting method of claim 1 comprising:

a. coupling nearly a full 720 electrical degrees of substantially symmetrical full-cycles of a.c. electrical power flow between the source and the load for each successive pair of a.c. power cycles during the first period of time;

b. coupling not more than about 630 electrical degrees of accumulative asymmetrical a.c. electrical power flow between the source and the load for each successive pair of a.c. power cycles during a first portion of the second period of time;

c. coupling not more than two half-cycle portions of asymmetrical a.c. electrical power flow between the source and the load for each pair of successive full-cycle periods of a.c. electrical power flow during a second portion of the second period of time; and, d. determining that the first portion of the second period of time serves to provide a substantially longer effective repetative period of electrical power flow during each pair of successive full-cycle periods of a.c. electrical power flow than that provided during the second portion of the second period of time.

7. Timed lighting method of claim 1 comprising the further steps of:

touching of an electrode by a person; and, resetting the timing device operation by a change of electric potential induced in the electrode by touching so as to effectively recommence said first period of time.

8. Timed electrical lighting apparatus comprising a substantially series circuit hookup and, therefor including:

a. a source of alternating current electric power coupled with said series circuit;

b. load means coupled effectively in series with said circuit;

c. timed switch means having at least a first terminal means and a second terminal means coupled effectively in series with said circuit, and further comprising:

ca. semiconductor switch means coupled between said first terminal and said second terminal;

cb. timing circuit means coupled with said semiconductor switch means, effective to produce at least a first time period state followed by a second time period state, whereby start of said first time period state is initiated by commencement of power flow through said circuit and such first time period persists for a predetermined length of time, and further that during said first time period substantially full-cycles of alternating current power flows through said semiconductor switch means, and that during said second time period a portion of every-other half-cycle of alternating current power flows through said semiconductor switch means; and, d. d.c. power supply means coupled with the semiconductor switch means and effective to derive electrical power from any voltage drop developed thereacross which is rectified and coupled with the timing circuit means.

9. Timed lighting apparatus of claim 8 wherein said semiconductor switch means comprises thyristor means having gate means coupled with said timing circuit means effective to produce a timed state control signal which serves to turn said thyristor ON for a succession of substantially full a.c. power cycles during the first timing period, and for a portion of every-other successive a.c. power half-cycle during the second timing period.

10. Timed lighting apparatus of claim 9 wherein said d.c. power supply means comprises delay circuit means coupled with said timed state control signal and said gate means, effective to inhibit the turn ON of the thyristor for a small percentage of at least one half-cycle of each a.c. power full cycle during at least the first timing period, whereby further that when the voltage drop developed across the thyristor due to current flow to the said load increases to a finite preconductive value, the said thyristor will then be turned ON and furthermore that said voltage drop obtained just prior to thyristor turn ON is coupled by way of diode means to effectively charge a capacitor means, with the resulting charge stored therein serving to provide d.c. electrical power.

11. Timed lighting apparatus of claim 8 wherein said semiconductor switch means comprises:

unidirectional thyristor means, such as silicon controlled rectifier, coupled inverse-parallel with a power diode (e.g., diode cathode to thyristor anode; diode anode to thyristor cathode); said thyristor having gate electrode means coupled with said timing circuit means, whereby said timing circuit means produces a timed state control signal which serves to turn said thyristor ON for a substantially full portion of every-other a.c. power half-cycle during the first timing period, and ON for a lessor portion of every-other a.c. power half-cycle during the second timing period; and, the power diode couples a.c. power therethrough for substantially a fully portion of every-other alternate a.c. power half-cycle.

12. Timed lighting apparatus of claim 11 wherein said d.c. power supply means comprises delay circuit means coupled with said timed state control signal and said gate means, effective to inhibit the turn ON of the thyristor for a small percentage of the a.c. power first half-cycle during at least the first timing period, whereby further that when the voltage drop developed across the thyristor due to current flow to the said load increases to a finite preconductive value, the said thyristor will then in effect be instantly turned ON while the voltage drop obtained just prior to thyrsistor turn ON is coupled by way of diode means to effectively charge a capacitor means, with the resulting charge stored therein serving to provide d.c. electrical power.

13. Timed lighting apparatus of claim 9 wherein said timing circuit means comprises digital counter means clocked by a clocking signal means to produce the timing state signal output therefrom which couples with said thyristor means to effect the substantially FULL portion of every other half-cycle of a.c. power flow through the thyristor during the first timing period, and LESS than FULL portion of every-other half-cycle of a.c. power flow through the thyristor during the second timing period.

14. Timed lighting apparatus of claim 13 wherein said clocking signal means couples with the a.c. electric power to effectively obtain a frequency signal therefrom which produces a clocking signal synchronized with the a.c. power frequency, wherein further said clocking signal is skewed in phase from that of the a.c. electric power, resulting in the producing of a delayed pulse output from the counter means which has a transistion occurance which is substantially retarded from that of zero-crossover of the a.c. power cycle waveform and may be combined with the timed state control signal so that during the first timing period the substantially FULL portion of every-other half-cycle of a.c. power flow may be obtained through the thyristor means, whilst during a first portion of the second timing period a.c. power will couple through the thyristor for a lesser portion of every-other a.c. power half-cycle, and during a second portion of the second timing period a.c. power coupling through the thyristor will be INHIBITED for at least most of each first half-cycle and that during every-other alternate a.c. power second half-cycle substantially a full portion of a.c. power flows.

15. Timed lighting apparatus of claim 8 having electrode means, such as a "touch plate", coupled with said timing circuit means and effective to produce immediate resetting of the timing means to the start of the first time period state whenever said electrode means is touched by a person.

16. Timed electrical controller apparatus means comprising a substantially series circuit hookup and therefor comprising:

a. source of alternating current electrical power coupled with said series circuit;

b. load means coupled effectively in series with said circuit;

c. timed switch means having at least a first terminal means and a second terminal means coupled effectively in series with said circuit, and further comprising:

ca. semiconductor switch means coupled between said first terminal means and second terminal means;

cb. time control signal means coupled with said semiconductor switch means, effective to produce a first time period signal which enables about fully substantially bidirectional a.c. power flow through said semiconductor switch means, followed by a second time period signal which enables a reduced level of unilateral a.c. power flow through said semiconductor switch means; and, d. d.c. power supply means coupled with said semiconductor switch means and effective to produce d.c. power from signals present across the semiconductor switch means during a portion of each a.c. power cycle.

17. Timed controller apparatus of claim 16 wherein said semiconductor switch means comprises bilateral thyristor means which is turned ON for a substantial portion of each successive a.c. power cycle during said first time period to provide substantially bidirectional a.c. current flow therethrough, and further that said semiconductor switch means is turned-on during a lesser portion of each successive a.c. power cycle during said second time period to provide substantially unidirectional a.c. current flow therethrough.

18. Timed controller apparatus of claim 17 wherein during said first time period the ON state of the said semiconductor switch means is retarded a small percentage of at least one half of each a.c. power cycle allowing for a smallish portion of the a.c. power to appear across the semiconductor switch means terminals immediately prior to such turn ON, whereby the smallish a.c. power portion is rectified and utilized as a source of d.c. power for operation of circuits attendant with the timed controller.

19. Timed controller apparatus of claim 16 wherein said semiconductor switch means comprises unidirectional thyristor means coupled inverse parallel connection with power diode means (e.g. diode cathode to thyristor anode; diode anode to thyristor cathode) whereby said thyristor is turned ON during said first time period and a.c. current flow is bidirectional, being in one direction through the thyristor and in the other direction through the power diode, whilst during said second time period the thyristor is turned OFF (e.g., not turned ON) and a.c. current flow is substantially unidirectional being obtained primarily through the power diode.

20. Timed controller apparatus of claim 16 whereby said semiconductor switch means comprises thyristor means and said second time period is further provided as a plurality of portions, whereby during a first portion thereof the time control signal means produces a signal which effects a first period of delay prior to turn-ON of the thyristor means during the every-other half-cycle portion of a.c. power flow, and during next time period portions thereof the time control signal means produces signals which effect successively longer repetative periods of delay prior to turn-ON of the thyristor means during the every-other half-cycle portion of a.c. power flow.

* * * * *